United States Patent [19]

Valente

[11] Patent Number: 4,575,891

[45] Date of Patent: Mar. 18, 1986

[54] TOILET SEAT DISINFECTANT WIPE

[76] Inventor: Mark Valente, 4301 - 13th Ave. N., St. Petersburg, Fla. 33713

[21] Appl. No.: 670,258

[22] Filed: Nov. 9, 1984

[51] Int. Cl.[4] ..... A47K 7/03

[52] U.S. Cl. ..... 15/104.93; 4/233; 15/210 R; 206/361; 206/812; 428/76; 604/289; 604/310; 604/378; 604/385 R

[58] Field of Search ..... 4/233; 15/104.93, 210 R; 206/812; 428/76; 604/385

[56] References Cited

U.S. PATENT DOCUMENTS

| | | | |
|---|---|---|---|
| 1,512,174 | 10/1924 | Isaac | 15/210 R |
| 2,038,957 | 4/1936 | Reach | 15/210 R |
| 2,762,158 | 9/1956 | Duffey . | |
| 3,221,356 | 12/1965 | Schirmer . | |
| 3,226,753 | 1/1966 | Charlap | 15/210 R |
| 3,227,614 | 1/1966 | Scheuer | 15/210 R |
| 3,495,918 | 2/1970 | Leland | 15/210 R |
| 3,846,158 | 11/1974 | Vasilyadis | 15/104.93 |
| 3,881,210 | 5/1975 | Drach et al. | 15/104.93 |
| 4,117,187 | 9/1978 | Adams et al. | 15/104.93 |

FOREIGN PATENT DOCUMENTS

| | | |
|---|---|---|
| 759698 | 11/1933 | France . |
| 622427 | 4/1981 | Switzerland . |

*Primary Examiner*—James C. Cannon

*Attorney, Agent, or Firm*—Joseph C. Mason, Jr.

[57] ABSTRACT

A small (2"×2") sterilizing pad device for individually sanitizing a toilet seat are disclosed. Each pad is provided with a one-fourth inch moist absorbent swab layer for sterilizing the toilet seat and a thin slightly stiff cardboard upper cap having a raisable thumb tab to be used for manipulating the pad over the upper surface of a toilet seat. The pads are of material which softens in water so that they will readily flush away in the toilet.

6 Claims, 2 Drawing Figures

TOILET SEAT DISINFECTANT WIPE

The present invention relates to a disposable biodegradable cleaning wipe for disinfecting toilet seats prior to use.

BACKGROUND OF THE INVENTION

This invention constitutes an alternative to other prior art protective devices such as tissue paper for toilet seat covers as is sometimes available. In many areas of the country and the world, the public toilet facilities are not as sanitary as good health practices would require. Therefore, there is a need for disinfecting devices for toilets so that communicable disease germs are not transmitted from one toilet user to the next. The prior art devices such as the toilet seat shaped tissue paper covers have not been satisfactory. Then covers frequently do not properly cover the entire seat area and are not generally available due primarily to cost, maintenance, and supply problems.

SUMMARY OF THE INVENTION

The invention provides a small but adequate absorbent pad which contains or is partially saturated with an antiseptic solution. The solution may be scented. The pad is small enough to be easily carried by a person and can, therefore, be readily available to wipe the entire upper surface of a toilet seat.

A suitable toilet seat wipe of the present invention comprises a small non-abrasive absorbent pad of fibrous material moistened with an antiseptic solution for sanitizing a toilet seat, said pad being provided with a thin protective means, said means having a thumb tab appendage which can be raised to provide a handhold for manipulating said pad over the surface of a toilet seat to provide sanitizing thereto, all of the material of said pad and protection means being decomposable in water to the extent that it will flush away in the toilet waste water without adversely affecting the sewer system.

The invention contemplates that it may be desirable to add a pleasing scent to the antiseptic solution.

Another embodiment of this invention comprises the use of an antiseptic solution which has a drying rate of less than one minute after the solution has been wiped over the surface of the toilet seat.

A still further embodiment of this invention comprises a two layer composite toilet seat wipe which comprises a first layer of non-abrasive absorbent material moistened with an antiseptic solution and a second layer in face to face contact with said first layer to form a composite wipe pad, said second layer being relatively stiff and having associated therewith a raisable thumb tab which can be raised to provide a a handhold for manipulating said wipe over the surface of the toilet seat, said wipe being biodegradable and decomposable in water to the extent that said wipe will flush away in the toilet without damage thereto.

In all embodiments it is contemplated and is a part of this invention that the toilet seat wipe be encapsulated in a wrapper material which is impermeable to said antiseptic solution.

BRIEF DESCRIPTION OF THE DRAWINGS

Various other objects and features of the invention are apparent from the following description and from the accompanying drawings, in which.

DETAILED DESCRIPTION OF THE INVENTION

Figure 1:
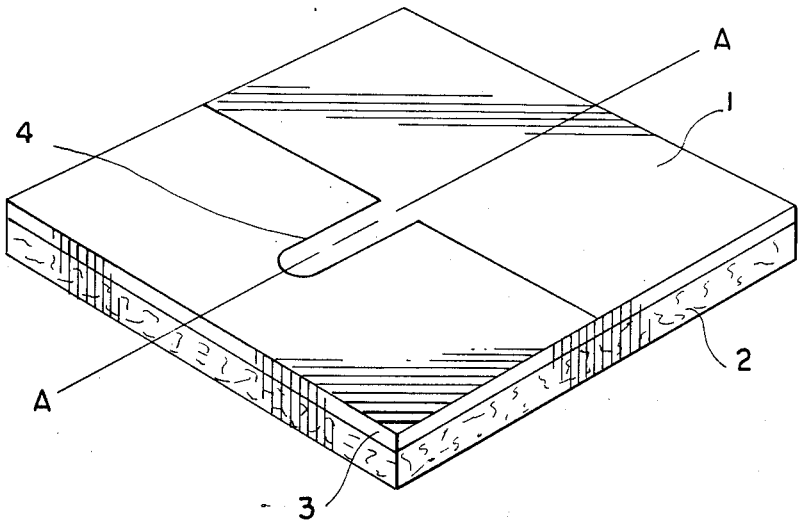
FIG. 1 is an isometric view of an individual pad, unwrapped, provided with an upper surface of relatively stiff material with a thumb tab, and, FIG. 2 is a vertical section through FIG. 1 on the line A—A showing the thumb tab in raised or lifted position.

The toilet wipe of the present invention embodies a pad having associated therewith absorbent material; the pad being small, e.g., about 2 inches square and one-quarter inch thick, although other dimensions will function equally well. The pad is individually wrapped or encapsulated with impermeable material to prevent evaporation of the antiseptic solution absorbed therein. The wrapper would not be decomposable in water and, therefore, should not be flushed down the toilet. Such packaging may be done by the prior art so that the wipe of the present invention can be disbursed from vending machines and can be carried in a wallet or purse. For use as herein described, a wipe is removed from its wrapper by the toilet user, applied to the upper surface of the toilet seat to disinfect it, and, then, the entire used wipe is dropped into the toilet to be flushed away.

The pad material of the wipe is not sewed together or sealed in any special manner. It can be cut into appropriate size, e.g. a two inch square, from a larger sheet of absorbent material. No sewing or special binding is needed. The pad material may be felted or laminated by pressure, heat, or a combination of pressure and heat to assure that the material will maintain substantially its form. The pad material must be non-abrasive so as to not mar, scratch, or deface the surface of the toilet seat.

Each wipe is entirely biodegradable and decomposable in water to the extent that it will readily flush away into the sewer system or septic system without adversely affecting the drains and pipes of the system. The pad material may be of filabrated cellulose, fluffed cotton or wool fiber or disintegrated wood pulp which can be pressed, extruded, or molded into appropriate form. Several layers of ordinary facial tissue would also be satisfactory.

The pad material is wet or partially saturated with a disinfectant which can be any antiseptic solution. Examples may include alcoholic solutions, silver nitrate, diluted sodium hydrochlorite solution, mercury-zink cyanide solutions, and any other substance that will inhabit the growth and development of microorganisms without necessarily disturbing them, i.e. any solution that will render an inaminate object free from pathogenic organisms or to render them inert. The selected disinfectant must be quick drying, e.g. less than one minute after application to the toilet seat, and non-irritating to the skin. The antiseptic solution applied to the pad material of the toilet wipe may preferably be pleasantly scented.

In order to provide sufficient control of the wipe by the toilet user, each wipe is preferably provided with a thin relatively stiff backing means such as a cardboard or overlay having associated therewith a thumb tab, partially severable such as by perforation, and being an integral part of the outside surface of the stiff overlay means. The thumb tab may be a separate device fastened to the stiff backing means if desired. The thumb tab may be lifted from its integral position by the use of a cutting edge, e.g. fingernail, or other lifting force so that the tab may be grasped by one hand. The wipe is now manipulated over the entire surface of the toilet seat to be disinfected. After use, the wipe may be dropped into the toilet bowl without fear of damaging or clogging the toilet drain, pipes, or sewer system.

The stiff overlay means such as thin cardboard may be attached to the absorbent pad material by any convenient means known to the art to form a composite structure. Adhesive backing on the cardboard would be appropriate. Lamination of the stiff backing containing the thumb tab to the pad material would be a preferable means of sandwiching the two surfaces.

Referring to FIG. 1 of the drawings herein, the unwrapped wipe 1 has associated therewith absorbent pad material 2 which has been moistened with the antiseptic solution. A thin, stiff cardboard cap 3 having a thumb tab 4 is shown as an overlay to the pad material 2. The thumb tab 4 is indicated as being partially raised or severed from its flat or integral position on the cap overlay 3, however, the thumb tab 4 can be raised more or less to a vertical position, perpendicular to the thin cardboard overlay cap 3 to provide a grip for the hand of the user to maneuver the wipe over the surface of the toilet seat (not shown).

Figure 2:
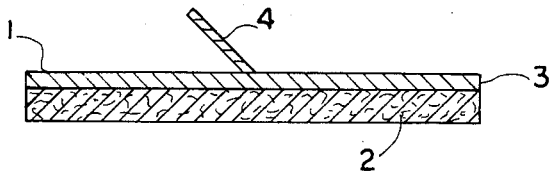

FIG. 2 shows a side view of the toilet wipe 1. The pad material or absorbent filler has the overlay cap 3 with a partially raised thumb tab 4 is indicated as aforesaid.

While the invention has been described with particular embodiments, it is to be understood that this invention is not to be limited thereto but is to be construed broadly and restricted solely by the scope of the appended drawings.

What is claimed is:

1. A disposable toilet seat wipe comprising a small non-abrasive absorbent pad moistened with an antiseptic solution and a thin, overlay protective means, said means having associated therewith a raisable thumb tab which can be raised to provide a handhold for manipulating said wipe over the outer surface of the toilet seat thereby disinfecting the toilet seat, said wipe being biodegradable and decomposable in water to the extent that the wipe will flush away in the toilet without damage thereto.

2. A disposable toilet seat wipe according to claim 1 wherein said protective means comprises a thin cardboard cap.

3. A disposable toilet seat wipe according to claim 1 wherein said antiseptic solution has a drying rate of less than one minute after application to the surface of the toilet seat.

4. A two layer composite toilet seat wipe which comprises a first layer of non-abrasive absorbent material moistened with an antiseptic solution and a second layer in face to face contact with said first layer to form a composite wipe pad, said second layer being relatively stiff and having associated therewith a raisable thumb tab which can be raised to provide a handhold for manipulating said wipe over the surface of the toilet seat, said wipe being biodegradable and decomposable in water to the extent that said wipe will flush away in the toilet without damage thereto.

5. A two layer composite toilet seat wipe according to claim 4 wherein said antiseptic solution has a drying rate of less than one minute after application to the surface of the toilet seat.

6. A two layer composite toilet seat wipe according to claim 4 wherein said composite pad is encapsulated in a wrapper material which is impermeable to said antiseptic solution.

* * * * *